US012765655B2

(12) United States Patent
Krattinger

(10) Patent No.: US 12,765,655 B2
(45) Date of Patent: Oct. 20, 2026

(54) DEVICE AND METHOD FOR SHAPING AND TREATING KERATIN FIBRES SUCH AS THE HAIR

(71) Applicant: Angie Krattinger, Gals (CH)

(72) Inventor: Angie Krattinger, Gals (CH)

( * ) Notice: Subject to any disclaimer, the term of this patent is extended or adjusted under 35 U.S.C. 154(b) by 177 days.

(21) Appl. No.: 18/290,788

(22) PCT Filed: Jul. 21, 2022

(86) PCT No.: PCT/IB2022/056726
§ 371 (c)(1),
(2) Date: Jan. 21, 2024

(87) PCT Pub. No.: WO2023/002418
PCT Pub. Date: Jan. 26, 2023

(65) Prior Publication Data

US 2024/0245183 A1 Jul. 25, 2024

(30) Foreign Application Priority Data

Jul. 23, 2021 (CH) ..... 70094/2021

(51) Int. Cl.
*A45D 2/12* (2006.01)
*A45D 2/14* (2006.01)
*A45D 7/04* (2006.01)

(52) U.S. Cl.
CPC ..... *A45D 2/127* (2013.01); *A45D 2/146* (2013.01); *A45D 7/045* (2013.01)

(58) Field of Classification Search
CPC ..... A45D 2/02; A45D 2/125; A45D 2/127; A45D 2/146; A45D 2/18; A45D 2/22; A45D 2/24; A45D 2/2464; A45D 7/045
See application file for complete search history.

(56) References Cited

U.S. PATENT DOCUMENTS 1,530,854 A 3/1925 Putt
2,663,302 A * 12/1953 Palitti ..... A45D 2/2492 132/246
3,968,805 A * 7/1976 Sobeck, Jr. ..... A45D 19/012 132/270
5,411,040 A 5/1995 Forrest
6,647,989 B1 * 11/2003 De Benedictis ..... A45D 2/18 132/273

(Continued)

FOREIGN PATENT DOCUMENTS

DE 202006013972 U1 12/2006
FR 1259455 A * 3/1961
JP 4859527 B2 1/2012

OTHER PUBLICATIONS

English Language ISR for PCT/IB2022/056726.

*Primary Examiner* — Rachel R Steitz

(57) ABSTRACT

A device for receiving at least one strand of hair or other keratinous fibers (mane, hair), having at least one strand-receiving surface configured to enable the formation of, from at least one strand of hair or other keratinous fibers, at least two undulations having winding axes that are not collinear with one another and/or of different diameters, the device comprising a distal end and a proximal end. The device is at least partly made from hemp. A method for shaping and treating keratin fibers such as hair is also disclosed.

5 Claims, 11 Drawing Sheets

(56) References Cited

U.S. PATENT DOCUMENTS

| | | | | |
|---|---|---|---|---|
| 7,500,487 | B2 * | 3/2009 | Kobayashi | A45D 7/06 132/222 |
| 2002/0056467 | A1 * | 5/2002 | Srivastava | A45D 8/001 132/273 |
| 2012/0227757 | A1 * | 9/2012 | Fardoe | A45D 8/20 132/246 |
| 2015/0053225 | A1 * | 2/2015 | Harvie | G09B 19/00 132/273 |
| 2017/0042268 | A1 * | 2/2017 | Lessard | A42B 1/041 |
| 2017/0156470 | A1 * | 6/2017 | Nardi | A45D 7/00 |

* cited by examiner

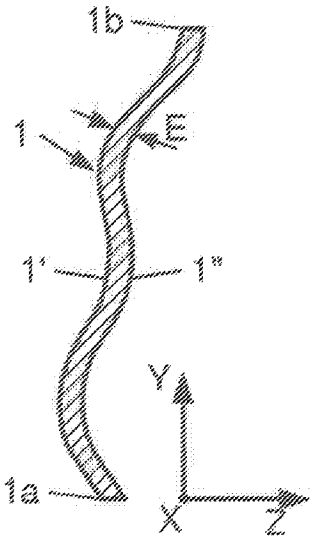
Fig. 6b
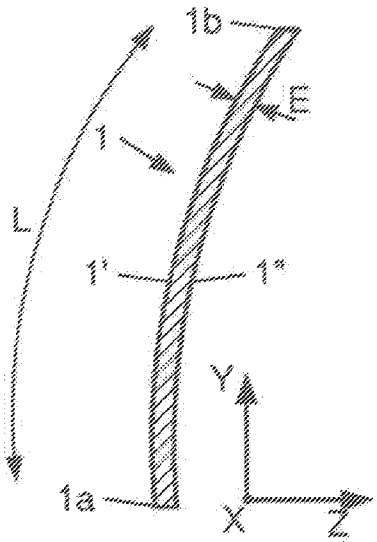
Fig. 6a
Fig. 6c
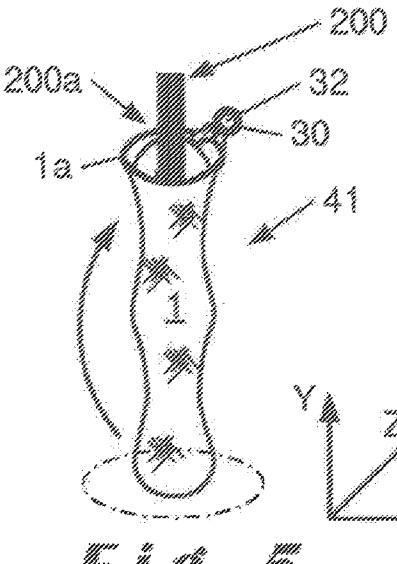
Fig. 5
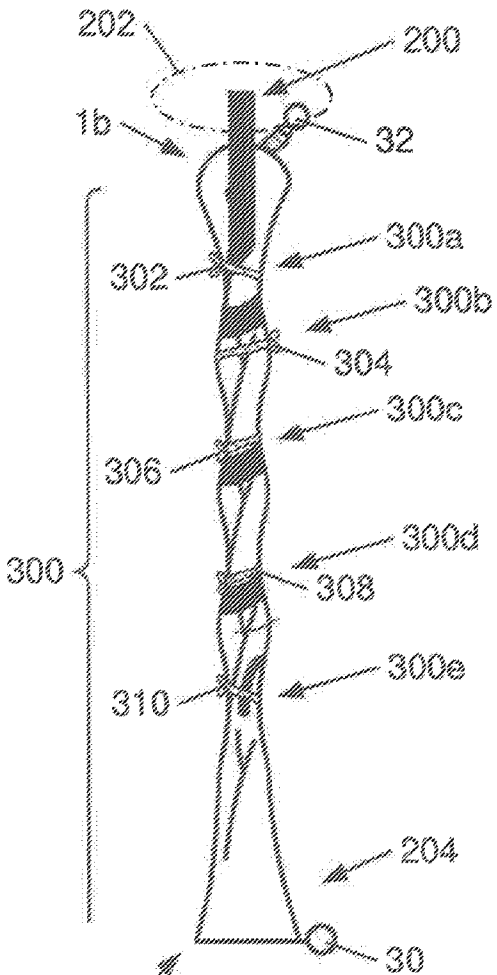
Fig. 4

DEVICE AND METHOD FOR SHAPING AND TREATING KERATIN FIBRES SUCH AS THE HAIR

FIELD OF THE INVENTION

The present invention relates to the field of keratin fiber treatment, such as hair, animal hair or other hairs. More particularly, it relates to shaping and keratinous treatment devices, forming hair curlers for hair, animal hair or other hairs. The invention also relates to a process for shaping and treating hair, animal hair or other hairs.

BACKGROUND TO THE INVENTION

Healthy, beautiful hair has always been seen as a major seductive asset. For centuries, therefore, there has been a constant quest to maintain it and preserve its radiance. We've also been constantly looking for ways to improve or modify curling techniques. One such technique is perming.

Hair perming is a curling technique that can last from 3 to 6 months. It can be applied to all hair types. For example, short, long, straight or curly hair. Perms are even applied to naturally wavy hair that could do without them.

In principle, hair perming involves the use of a curling chemical and curlers, for example, to achieve well-defined curls or waves over long periods of time, typically months.

There are various methods for producing perms.

The first method is the hot perm. With this technique, the hair is impregnated with a solution of sulfite or bisulfite. These substances are applied to curlers, which are then heated. Heating, typically to over 80° C., causes an internal change in the hair's keratin. The heat breaks down the keratin's cystic bridges. The hair is thus deprived of its rigidity and can be shaped. Once the hair has been shaped, the liquid is left to cool, while the hair is held in place by the curler. During the cooling process, new disulfide bonds are formed, thus restoring the hair's rigidity. As a result, the hair stiffens in its wavy position. This method is no longer used.

Around 1942, a new technique was developed for low-temperature perming, known as "cold perming". This method uses wooden, plastic or metal curlers and two types of liquid. A first liquid is used for a reducing action and a second liquid for neutralizing.

In this "cold" method, the process consists of the following steps:

- first shampoo, roll up the curlers and then impregnate the hair with a curling solution and cover the head with a cap, typically made of plastic. The curlers are loosely rolled up to allow the hair to swell under the action of the curling liquids;
- leave the liquid to act, and impregnate the hair with more liquid to saturate the effect;
- when the wave is deemed satisfactory, the hairdresser proceeds with neutralization, keeping the hair around the curlers. The hair is rinsed and an oxidizing solution is applied.

In the cold method, curling liquids are typically salts of thioglycolic acid or thiolactic acid. Neutralizing liquids are used to remove hydrogen from disulfide bonds, reconstitute these bonds and fix the desired hair deformation.

A third technique is the "lukewarm" perm. This is a compromise between the hot and cold methods. In this case, the lower heat is compensated for by the use of more active liquids than those used during the "hot" technique. These liquids contain sulfites and thyoglycolate. The lukewarm technique does not require neutralization.

All the methods used to date present various problems, including the use of a number of curlers around which the hair has to be carefully wrapped, and the use of chemicals that can damage or deteriorate the appearance of the hair, or that don't allow a perm to last long enough. Furthermore, there's a need for a new technique that not only perms hair, but also improves hair properties such as elasticity, shine and moisturizing.

The present invention solves this problem by proposing a new type of curler and a new process.

SUMMARY OF THE INVENTION

For years, there has been a lot of research in order to find a solution for long-lasting styling, with curlers that provide products or nourishing material for the hair and make it look beautiful at the same time.

There is no process that satisfies these 2 requirements. Either the curler material has a harmful effect on the hair (plastic, hot iron, metal), or the treatments are too aggressive for the hairstyle to last long enough.

The applicant has solved this problem by proposing a device made of natural material made, at least in part, of hemp. The limitations of existing processes have been resolved by proposing a hair treatment method based on the use of the device or curler of the invention.

In a first aspect, the invention is implemented by a curler-forming device designed to receive at least one strand of hair or other keratinous fibers, having at least one surface for receiving the hair or other keratinous fibers, configured to enable the formation, from at least one strand of hair or other keratinous fibers, of at least two waves having winding axes that are not collinear with each other and/or of different diameters, the device comprising a distal end and a proximal end.

The hair curler of the invention is made, at least in part, of hemp. The advantage of using hemp material, at least for the receiving surface of the hair or other keratinous fibers of the hair curler of the invention, lies in the fact that, when used, the hair curler and the hair will combine so that the hair takes all the benefits of the hemp, whereas existing plastic hair curlers are a barrier and have harmful effects on the hair.

In one embodiment, the curler device comprises at least 60%, preferably at least 90%, even more preferably at least 95% hemp, and even more preferably 100%.

In one embodiment, the curler device has a strip that has a length greater than its greatest width, and a thickness less than said width. In one embodiment, the curler device is a solid strip of parallelepiped shape.

In one embodiment, the curler device comprises a plurality of fasteners.

In one embodiment, said plurality of fasteners comprises at least two opposing groups of fasteners, each arranged at an edge of said curler device.

In one embodiment, the curler device comprises at said distal end and/or said proximal end, means for attaching said distal end to said proximal end.

In one embodiment, the curler device has a uniform composition along its entire length.

In one embodiment, the curler device is composed of several segments, at least two of which have a different composition and/or different shape and/or different size.

In one embodiment, the curler device is in the form of a case comprising at least one distal end having an opening for receiving, in a folded position of the curler, at least the portion of the curler comprising said proximal end.

In one embodiment, the curler device comprises at least one closed proximal end.

In one embodiment, the curler device comprises a support on which its hemp portion is fitted.

In one embodiment, the curler device comprises at least two branches, each designed to receive a portion of said at least one strand of hair.

The invention is also realized by a process for shaping a strand of hair or other keratinous fibers comprising at least the steps of:

present the curler device as described above;

position a strand of hair or other keratinous fibers so that at least a portion of the strand is in contact with at least one surface of said curler device;

wet the strand of hair or other keratin fibers;

twist the curler device lengthwise by holding the strand, at least partially, in contact with said at least one surface of said curler device to intertwine the strand with the curler device lengthwise;

laterally tighten the curler device at a plurality of points to hold the strand against at least one surface of the curler;

fold back the curler device to insert into said opening at least part of the part of the device comprising the proximal end.

In the case of a curling shaping process, the step of wetting the hair or other keratinous fibers is performed by wetting the hair or other keratinous fibers with water prior to contacting the hair or other keratinous fibers with the curler devices.

In the case of a perming process, the step of wetting the hair or other keratinous fibers is primarily a step performed by wetting the hair or other keratinous fibers with chemicals after the curler-forming devices are in place and before the curler-folding step.

In one embodiment, the process comprises a drying step at a temperature below 60° C., preferably below 50° C., even more preferably below 45° C., for example around 40° C., and preferably above 30° C. (temperature ranges between 30° C. and 60° C., preferably between 30° C. and 50° C., and even more preferably between 30° C. and 45° C.).

In one embodiment, the width of the curler device, before the curler device is twisted, and for any section of the strand along the length of the curler device, is 50% wider than the width of the strand, preferably twice as wide as the width of the strand.

With the hair curler of the invention, strands of treated hair or other keratinous fibers are more evenly distributed on the curler device, forming a single winding when the process is applied. When perming hair, for example, the process reduces chemical consumption while maintaining a long-lasting perm. The reduction in chemical consumption can be as much as 50%, as prior art methods require the hair (or other keratinous fiber) to be wound in several superimposed layers of hair (or keratinous fiber), and therefore require more chemicals to treat all the superimposed layers of hair (or keratinous fiber).

BRIEF DESCRIPTION OF THE DRAWINGS

Further details of the invention will become clearer on reading the following description with reference to the appended figures:

FIG. 4 illustrates the application of a strand of hair to a curler device according to the invention;

FIG. 5 shows a curler device in the folded position;

FIGS. 6*a*, 6*b*, 6*c* show 3 side sections of curler devices according to the invention;

DESCRIPTION OF THE INVENTION

Figure 1:
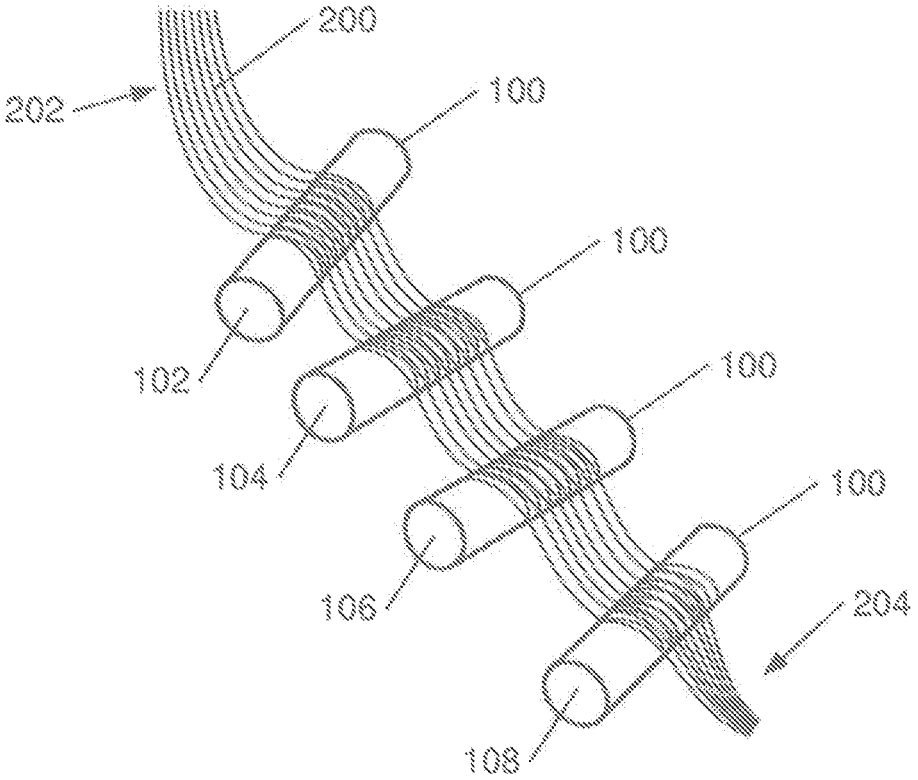
PRIOR ART Fig. 1
FIG. 1 illustrates a process using prior art curlers.
Figure 3:
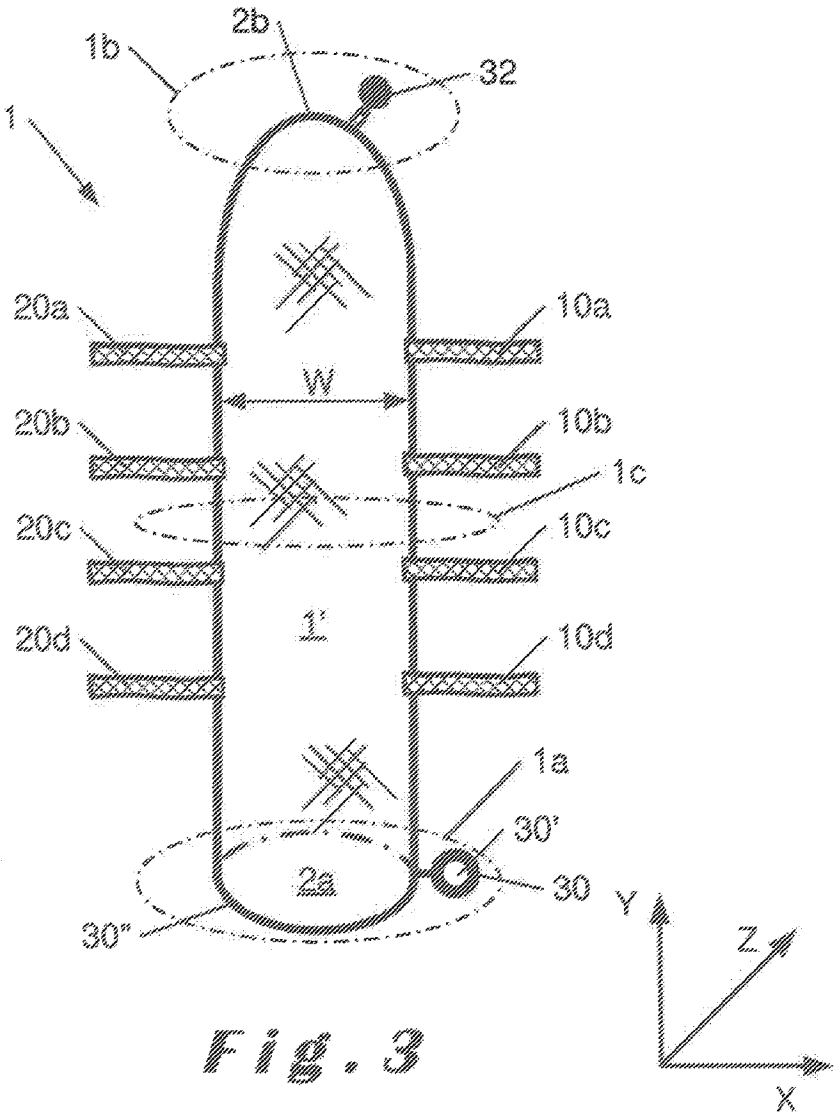
FIG. 3 shows a three-dimensional view of a preferred embodiment of the curler device according to the invention.
Figure 2:
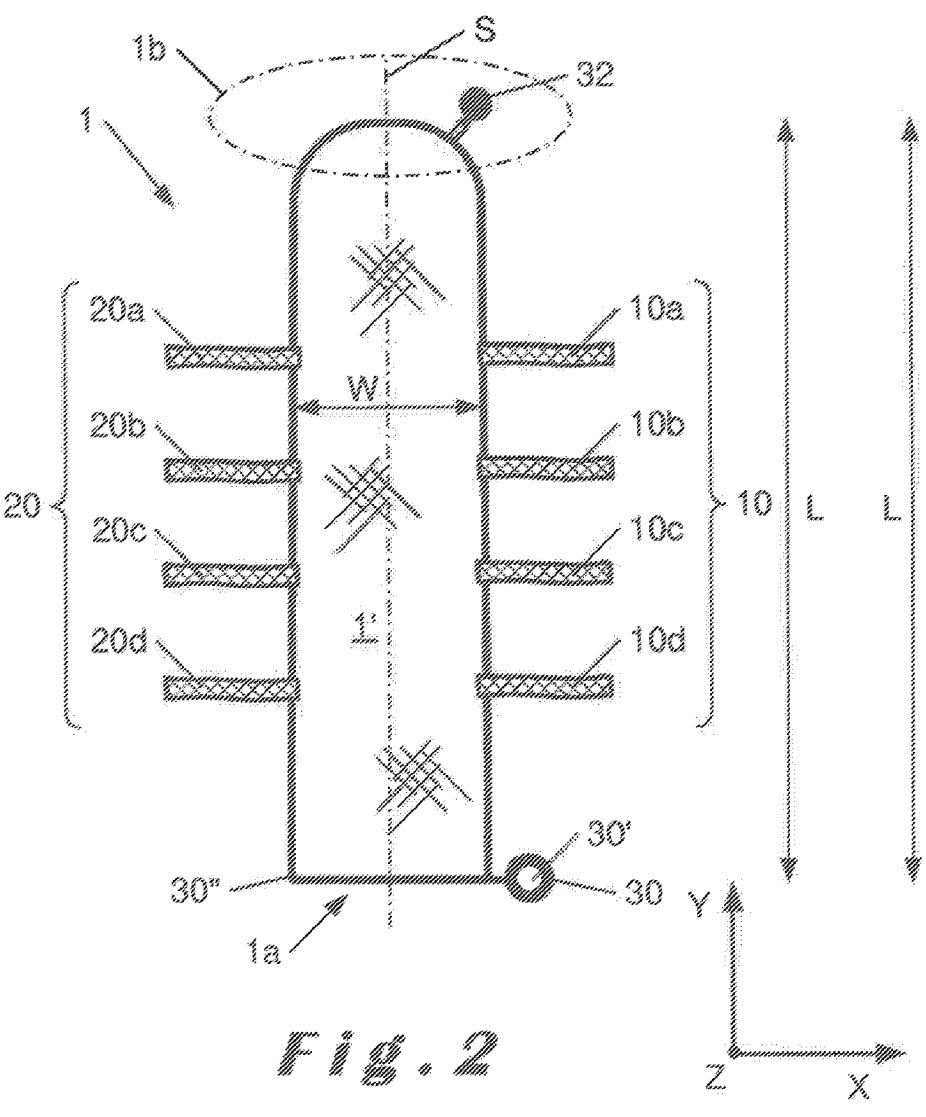
FIG. 2 shows a cross-section of a preferred embodiment of the curler device according to the invention.

The present invention will be described in relation to particular embodiments and with reference to certain drawings, but the invention is not limited thereto. The drawings described are schematic and non-limiting only. In the drawings, the size of some elements may be exaggerated and not drawn to scale for illustrative purposes. Dimensions and relative dimensions do not correspond to actual reductions in the practice of the invention.

It should be noted that the term "comprising" in the description and claims is not to be construed as being limited to the means listed below, i.e. it does not exclude other elements.

The reference to "an embodiment" throughout the specification means that a particular feature, structure or character described in relation to the embodiment is included in at least one embodiment of the invention. Thus, the expressions "in one embodiment" or "in a variant", which appear at various points in the description, do not necessarily all refer to the same embodiment, but to several. In addition, features, structures or characteristics may be combined in any suitable manner, as would appear to the person skilled in the art from this disclosure, into one or more embodiment(s). Similarly, various features of the invention are sometimes grouped together in a single embodiment, figure or description, in order to make the disclosure more readable and improve understanding of one or more of the various inventive aspects. Furthermore, while some embodiments described below include some features included in other embodiments, but not others, combinations of features from different embodiments are intended to fall within the scope of the invention, and from different embodiments. For example, any of the claimed embodiments may be used in any combination. It is also understood that the invention can be put into practice without some of the many specific details stated. In other cases, not all structures are presented in detail so as not to obscure the understanding of the description and/or figures.

As used herein, the term "curler" is broadly understood to mean a hair curler, i.e. a device, element or set of elements configured for use in hair care, particularly for shaping hair strands and/or improve the visual appearance and/or mechanical properties of the hair, such as elasticity or breakage resistance.

In a first aspect, the invention is implemented by a curler 1 designed to receive at least one hair strand 200, having at least one hair-receiving surface 100, 102, 104, 106, 108 configured to enable the formation, from at least one hair strand 200, of at least two waves 202-208 having winding axes that are not collinear with one another and/or of different diameters, the curler 1 comprising a distal end 1*a* and a proximal end 1*b*. The hair strand has a distal end 204 and a proximal portion 202, which is located on the base side of a person's hair.

In particular, the curler 1 of the invention is made, at least in part, from hemp. This hemp is advantageously the textile fiber derived from the *Cannabis sativa* plant of the *sativa* subspecies.

In one embodiment, the curler comprises at least 60%, or at least 80% or at least 90% hemp. Preferably, the curler is made entirely of hemp.

In an advantageous variant, the curler 1 can also include other materials made from any dye-free textile.

Preferably, the part of the curler designed to roll up the strands of hair 200 is made entirely of hemp, so as to enjoy all its benefits during use. Of course, different types of hemp can be used to make the curler 1. The entire curler 1, or at least the portion of the curler 1 made of hemp, is preferably made from a hemp fabric forming a sheet obtained by the regular assembly of hemp threads or fibers, arranged in two series crossed at right angles, or more generally from a fabric, whether knitted, non-woven or woven.

In a preferred embodiment, the curler 1 has a strip which has a length L greater than its greatest width W, and a thickness E smaller than said width W. The curler 1 has a longitudinal axis S, which can be an axis of symmetry as in the embodiments illustrated in FIGS. 10, 11, 14, 15. The width of the proximal end 1*b* can be progressively reduced to end in a peak.

Preferred values for length L are between 5 cm and 50 cm, preferably between 10 cm and 30 cm.

Preferred values for the width W are between 3 cm and 20 cm, preferably between 5 cm and 15 cm.

Preferred values for thickness E are between 1 mm and 20 mm, preferably between 2 mm and 5 mm.

In an embodiment described further below, the curler 1 can have a case or bag shape, illustrated in FIGS. 3, 5, 21 and 22-28. Also, for example, all the variants shown in FIGS. 10 to 16 can be made in case or bag shape.

In variants, the curler 1 may comprise two portions which may have different lengths L, widths W and thicknesses E, or even be made of two different materials. The two portions may form a bag of uniform material or may be made of two strips sewn together (such a variant is not illustrated in the Figures).

Preferably, the curler 1 is a solid strip with a parallelepiped shape. The curler 1 may comprise two solid parallelepiped strips.

FIGS. 6*a*, 6*b*, 6*c* illustrate 3 different longitudinal sections, i.e. in the Y-Z plane, of curlers 1 according to the invention.

Preferably, the curler 1 comprises a plurality of fasteners (or ties) 10*a*-10*d*, 20*a*-20*d*. These fasteners are used to create nodes 302, 304, 306, 308, 310 during the process described below. The number of fasteners may be more than 10, possibly more than 20. In one embodiment, the curler 1 may also comprise no fasteners, and in the process described below, fasteners separate from the curler may be added. In one variant, the curler 1 may also comprise no fasteners, and when the procedure described below is carried out, a fastener is obtained by knotting the proximal portion onto itself. Fasteners 10*a*-10*d*, 20*a*-20*d* can be made from a variety of materials selected from cotton and hemp. Fasteners 10*a*-10*d*, 20*a*-20*d* can be elastics surrounded by hemp yarn, wool, or any form of natural textile, but ideally made of hemp yarn to reap all the benefits of hemp.

In one embodiment, illustrated in FIGS. 2, 3, 10 to 15, said plurality of fasteners 10*a*-10*d*, 20*a*-20*d* comprises at least two opposing groups 10, 20 of fasteners 10*a*-10*d*, 20*a*-20*d* (defined in the X direction of the Figures), each arranged at an edge of said curler 1.

In alternative embodiments, the side edges of the curler 1 need not be smooth and/or linear, and may feature steps or undulations. For example, in an embodiment illustrated in FIG. 16, the curler 1 may comprise protruding portions 4*a*, 4*b*, 4*c* and steps 4*d*, 4*e*, 4*f*. When carrying out the process described below, the protruding portions 4*a*, 4*b*, 4*c* and the steps 4*d*, 4*e*, 4*f* can be joined during a folding movement along the S axis, illustrated in FIG. 16 by an angle $\alpha$. In a further embodiment, the protruding portions 4*a*, 4*b*, 4*c* may have a different composition from the curler body 1.

In one embodiment, the curler 1 comprises at said distal end 1*a* and/or said proximal end 1*b*, means 30, 32 for attaching said distal end 1*a* with said proximal end 1*b*.

In a preferred embodiment, said means consist of two parts of a button system 30, 32, 402, 404, both parts of which are designed to close, such as a snap fastener. In one embodiment, said means 30, 32 are two textile strips covered with a different texture enabling, when brought into contact, a releasable connection to be obtained, such as Velcro. In other variants, the fastening means may comprise a metal clip button, a textile button, or any form of fastener known for hooking two parts together, such as a garment button. For attachment means, such as said button, there is no direct contact with the hair strand 200 to be treated and therefore it will be chosen according to the cost of this attachment means, and preferably of very good quality for long-term use. In the embodiment shown in FIGS. 22 to 28, the attachment means are two straps 34, 36 forming the free ends of a cord placed in a slide 38 forming (or placed close to) the edge of the distal end 1*a* of the curler 1. These straps 34, 36 are also made of hemp, for example.

In one embodiment, the curler 1 has a uniform composition along its entire length L.

Figure 18:
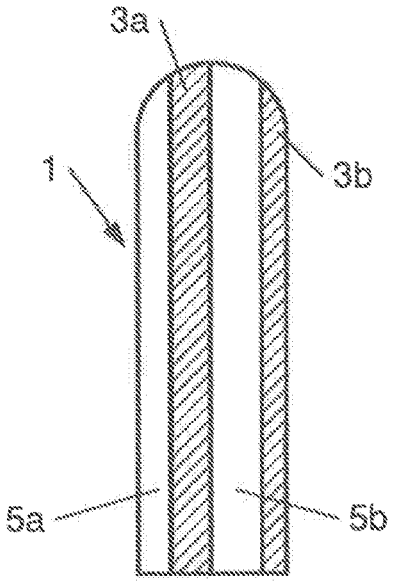
FIGS. 18 and 19 illustrate curler devices comprising a plurality of portions made of hemp.
Figure 19:
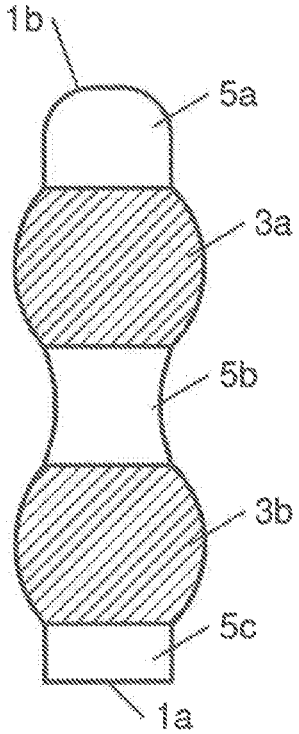

The curler 1 can also be composed of several segments 3*a*, 3*b*, 5*a*, 5*b*, of which at least two segments 3*a*, 5*a* have a different composition and/or shape and/or dimension. This is illustrated in FIGS. 18 and 19, which show segments 3*a*, 3*b* made of hemp and linked together by segments 5*a*, 5*b*, 5*c* which are not made of hemp. The non-hemp segments 5*a*, 5*b*, 5*c* may have different lengths, widths and thicknesses to the hemp segments 3*a*, 3*b*.

In some embodiments (FIGS. 2, 3, 4, 5, 8, 10 to 13, 16, 18 to 20, 21 and 22 to 28), the curler 1 has the shape of a case, also defined as a bag, comprising at least one distal end 1*a* having an opening 2*a* intended to receive, in a folded position of the curler 1, at least the part of the curler 1 comprising the proximal end 1*b*.

In one embodiment, the curler 1 comprises at least one proximal end 1*b* which is at least partially closed.

In a preferred embodiment, said proximal end 1*b* has a rounded shape illustrated in FIGS. 11, 12, 16, 18, 19, 21. The rounded shape can be any shape described by a polynomial, possibly a circular arc. Said closed proximal end 1*b* may, for example, have the shape of a triangle.

Figure 17:
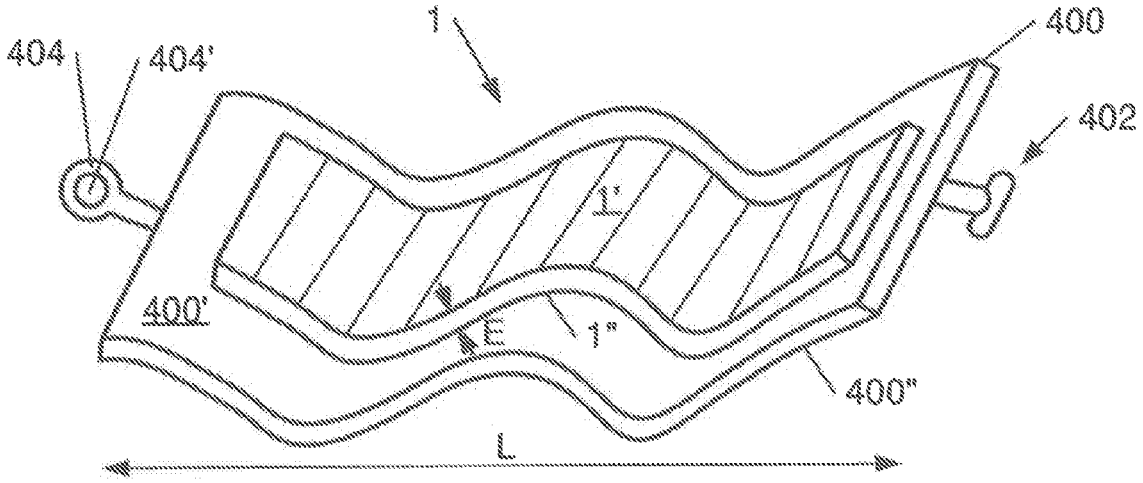
FIG. 17 shows a curler device comprising a shaping support.

In one embodiment, illustrated in FIG. 17, the curler 1 comprises a support 400 to which its hemp portion is fitted. Such a support can help to achieve the twist of the curler during its implementation. The said support 400 can be, for example, a reinforcing rod for the curler 1 or a support that makes it easier to fold and hold the curler 1 in its folded form shown in FIG. 5. The support should be made of a hair-friendly material.

Figure 14:
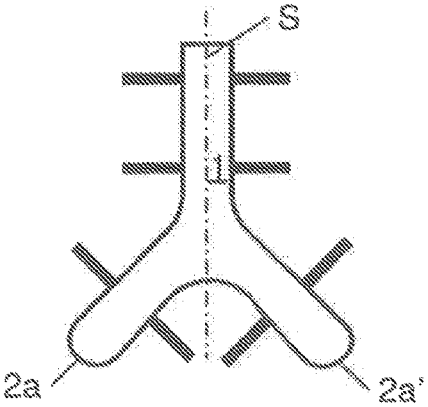
Figure 15:
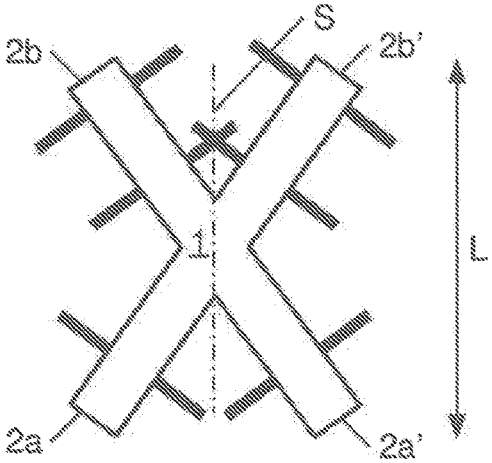
Figure 16:
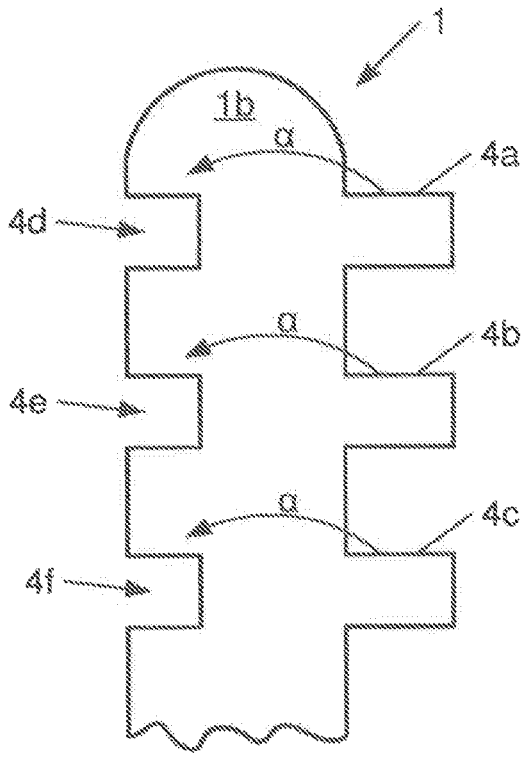

In an embodiment illustrated in FIGS. 14 and 15, the curler 1 comprises at least two branches 1''', 1$^{iv}$, each designed to receive a portion of said strand of hair 200. In one embodiment, at least one of said two branches 1''', 1$^{iv}$ may comprise an opening 2*a* for folding back at least part of the curler 1.

Figure 20:
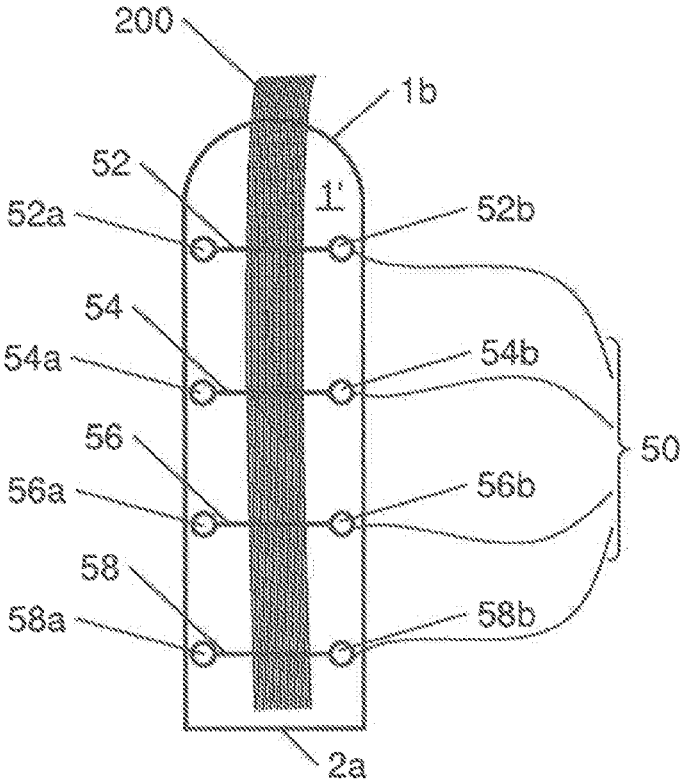
FIG. 20 illustrates an embodiment comprising fasteners arranged on at least one surface of the curler device of the invention.

In an advantageous variant, illustrated in FIG. 20, the curler 1 may comprise a fastening system 50 comprising fastening elements 52-58 for holding the strand 200 against the curler. Fastening elements 52-58 may comprise fastening areas 52*a*-58*c* integrated into the curler body 1. Fastening elements 52-58 and/or fastening areas 52*a*-58*c* may be made, at least in part, of hemp.

Figure 22:
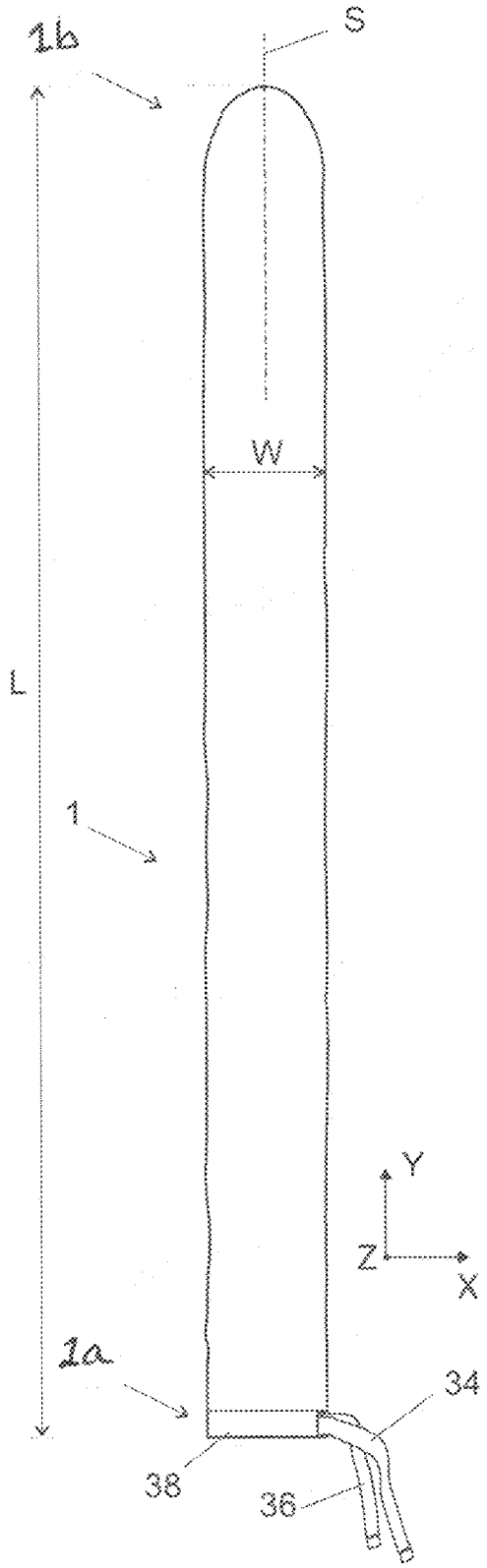
FIG. 22 shows a side view of a further embodiment of the curler device according to the invention, in its pre-installation position.
Figure 23:
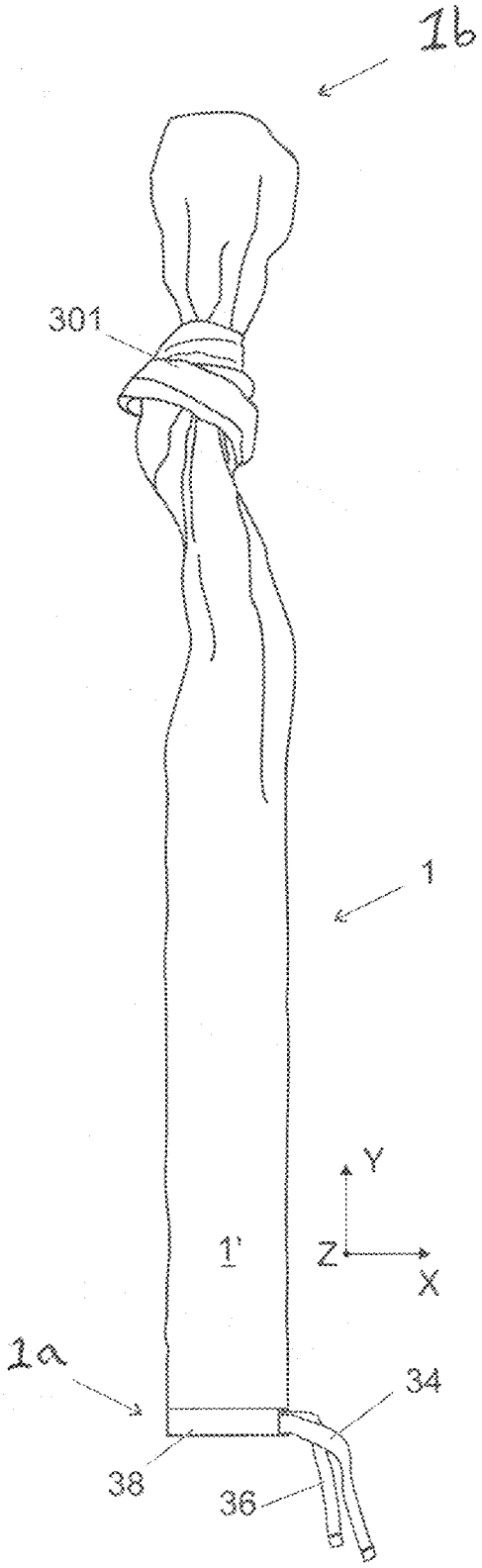
FIGS. 23 to 28 illustrate the various steps involved in applying the curler device shown in FIG. 22 to a strand of hair, corresponding to the process of shaping and treating hair with this curler device.
Figure 24:
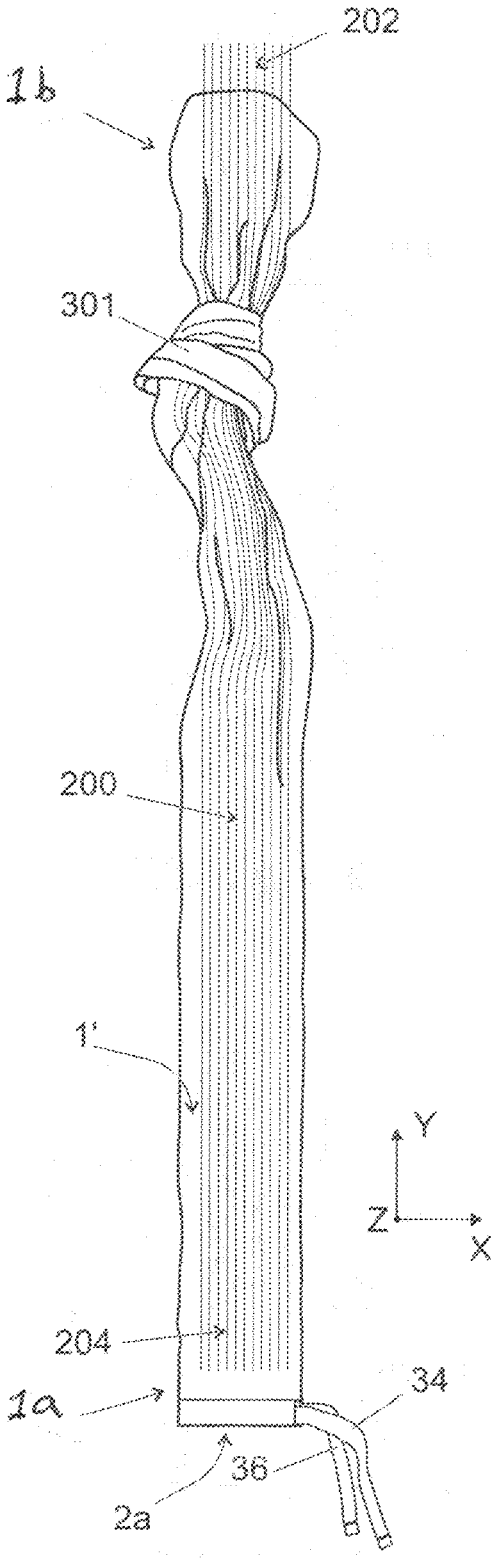
Figure 25:
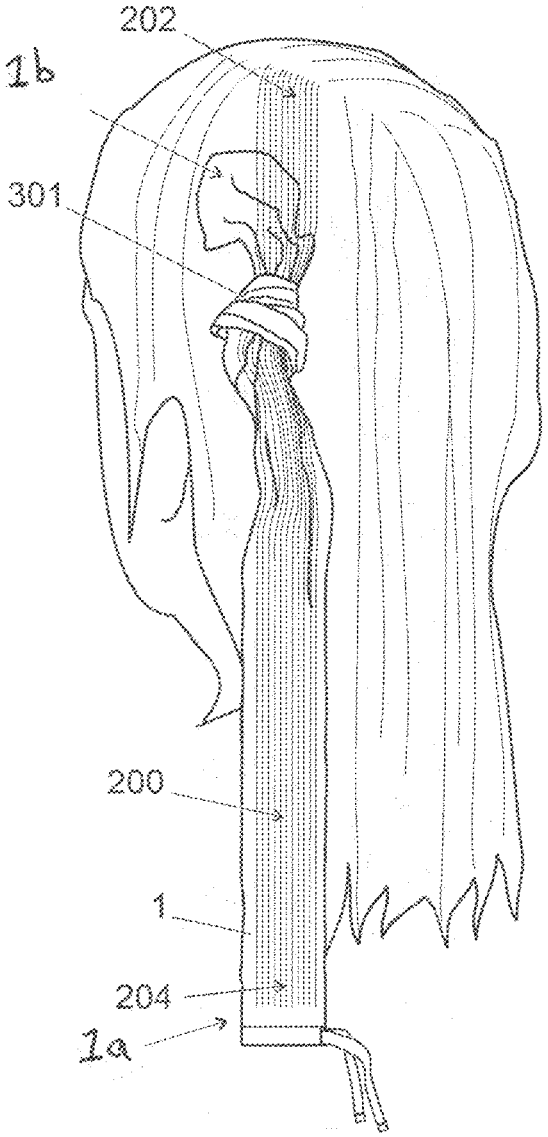

In an advantageous variant, illustrated in FIG. 22, the curler 1 forms a case or bag with its distal end 1*a* comprising the two straps 34, 36 which can slide in the slide 38, thus enabling the formed edge of this slide to be tightened and thus reducing the size of the curler opening 2*a*.

Process of the Invention

In a second aspect, the invention is realized by a process for shaping a strand of hair 200 comprising at least the steps of:

- present curler 1 as described above;
- position a strand of hair 200 so that at least a portion of the strand 200 is in contact with at least one surface 1' of said curler 1;
- wet the strand of hair 200;
- twist the curler 1 along its length L by holding the hair strand 200, at least partially, in contact with said at least one surface 1' of said curler 1 in order to intertwine the hair strand 200 with the curler 1 taken along its length L;
- tighten the curler 1 laterally at a plurality of points 300*a*-300*e* to hold the hair strand 200 against at least one surface 1' of the curler 1;
- fold back the curler 1 at least partially in the Y direction of its length in order to insert at least part of the proximal end 1*b* into said opening 2*a*, which is made possible by this turning movement between the inner face and the outer face of the section of the curler 1 comprising the opening 2*a* and the distal end 1*a*. FIG. 5 shows the curler 1 in its folded position and shape 41. This movement is similar to turning a sock inside out.

In a preferred method, the hair strand 200 is aligned with the longitudinal axis S of the curler 1.

In prior art processes, the hair strand 200 is wound several times in the same place along its length, as shown in FIG. 1. With the curler 1 of the invention, the strand 200 is wound, during the twisting of the curler 1, only along the curler 1 (i.e. in the Y direction in the Figures) and not in several layers of hair wound around the curlers. This results in a thin layer of hair on the curler 1 in its rolled and folded position. The thinness of the hair strand in contact with the curler 1 allows the substances produced by the hemp to penetrate more easily.

In one embodiment, the width of the curler arranged in contact with the curler, before the curler is twisted, and for any section of the curler along the length L of the curler 1, is equal to at least 80%, preferably at least 90%, of the width W of the curler 1.

In a preferred embodiment, the hair strand is much narrower than the flattened curler, as shown in FIG. 4. If the flattened curler band is much wider than the hair strand, this allows the hair to be tightly clamped when the curler is tightened, for example with fasteners. In preferred embodiments, the maximum width W of the curler, i.e. before it is twisted, is at least 50% wider, preferably 2 times wider, than the width of a hair strand 200 which is to be waved and placed on the curler 1.

In one embodiment, the tightening step is carried out by forming a plurality of knots 302, 304, 306, 308, 310 with the side fasteners 10*a*-10*d*, 20*a*-20*d*. Alternatively, a single knot 301 (FIGS. 23-24) is formed by looping the proximal portion of the curler 1, through which the distal end 1*a*, gripping the hair strand 200, is passed. This initial tightening of the curler at knot 301 to grip the hair strand in its proximal portion close to the skull, at location 300*a*, is completed (FIG. 26) by other tightening zones obtained by twisting the curler on itself. The result is the tightening zones 300*a*-300*e* . . . 300*f*.

In the embodiment shown in FIGS. 22-28, after the bag-shaped curler 1 has been folded (inverted), straps 34 and 36 are pulled, thereby tightening opening 2*a*, and then knotted together above knot 301, which remains inside the folded curler 1. It is thus understood that the two straps 34, 36, placed inside and outside the slide 38 which forms the edge of the opening 2*a*, are able to tighten the opening 2*a* by sliding into the slide and furthermore form means for fastening said distal end 1*a* with said proximal end 1*b* by tying a knot with the end of the fasteners, as with shoelaces.

This folded curler forms a full bag enclosing the intermediate section of the curler and most of the length of the strand 200. This full bag has a length L1, which is very small compared with the length L of the unfolded curler (FIGS. 2, 3, 22), this reduced length L1 being between approximately 1 and 3 times the greatest width W of the curler in its unfolded form.

In a preferred embodiment, and more particularly in the case of a shaping process via hair styling, the step of wetting the hair is carried out by wetting the hair with water, preferably before the hair is brought into contact with the curlers.

Figure 8:
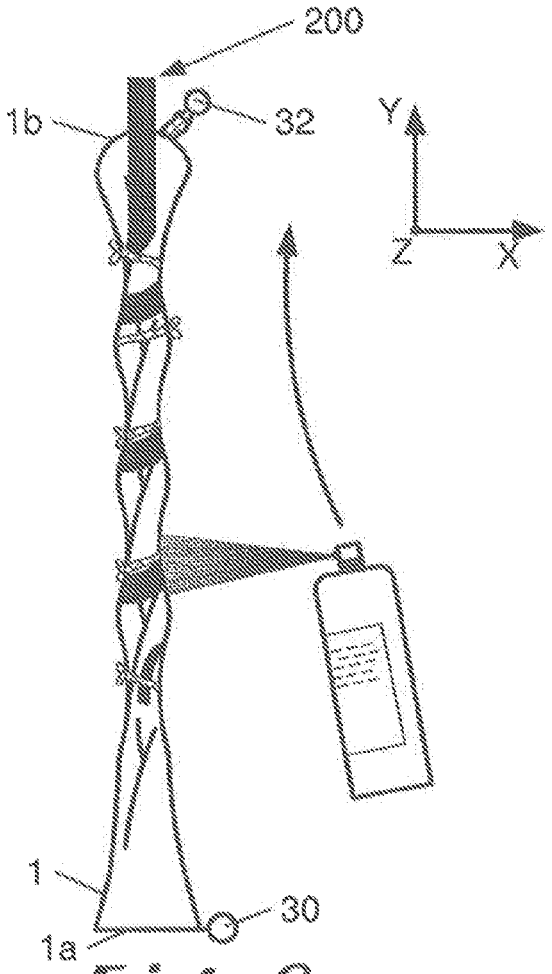
FIG. 8 illustrates a hair strand shape obtained by the process of the invention.
Figure 9:
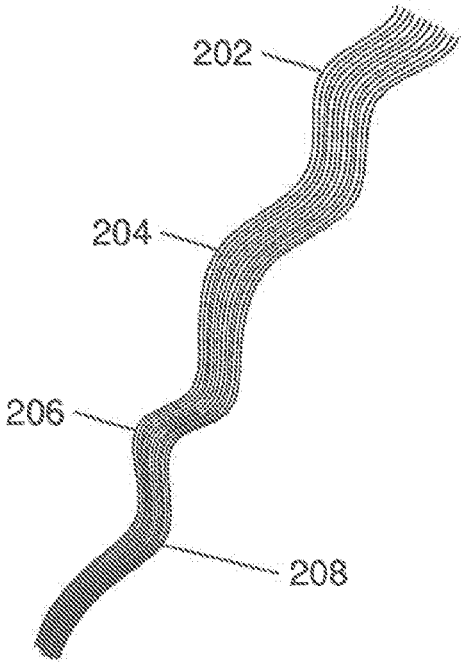
FIG. 9 illustrates one of the steps in a perming process according to the invention.
Figure 10:
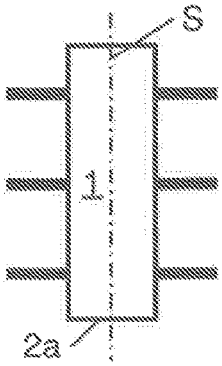
FIGS. 10-16 show several possible shapes of the curler device of the invention.
Figure 11:
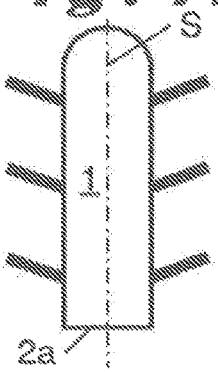
Figure 12:
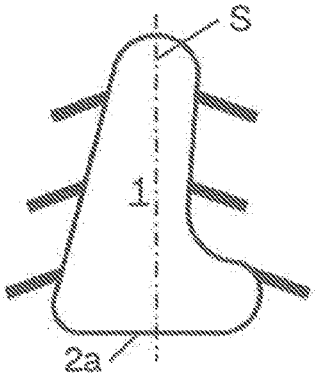
Figure 13:
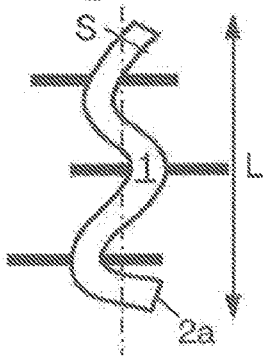
Figure 26:
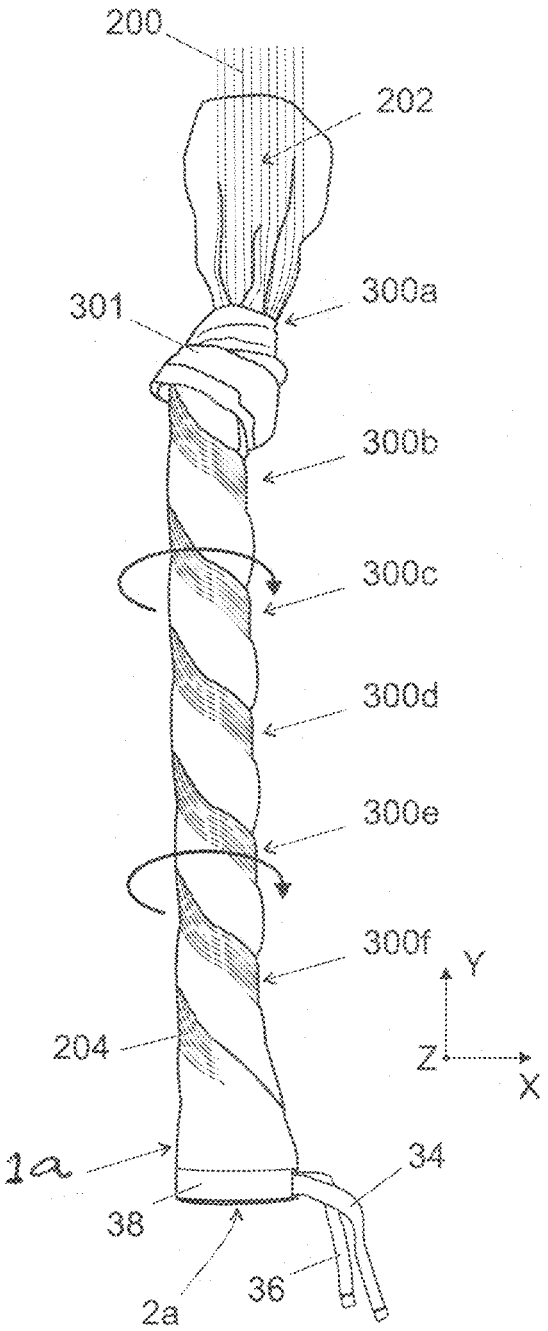
Figure 27:
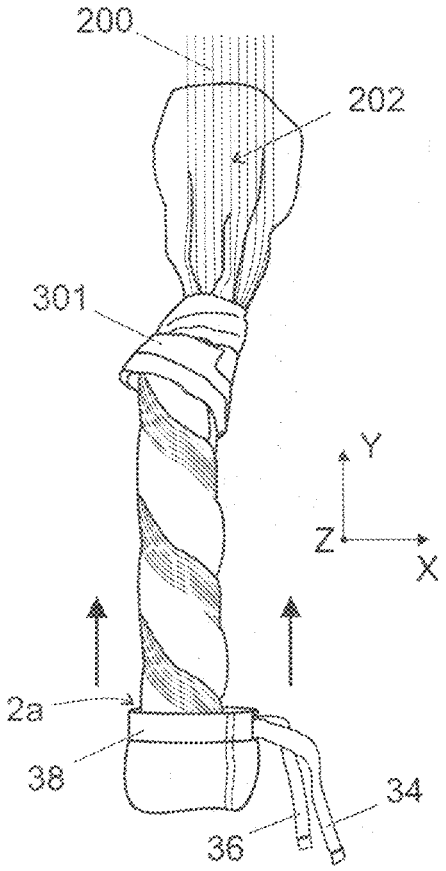
Figure 28:
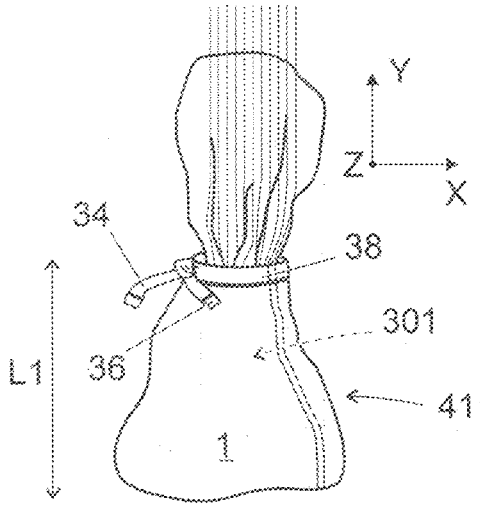

In one embodiment, before folding back the curler 1 as shown in FIG. 8 or FIG. 26, the curler is impregnated with hair treatment products. This is particularly useful when perming hair. These treatment products are applied just before folding the curler to protect the treated strand from the air and allow the curling chemical to do its work.

Figure 7:
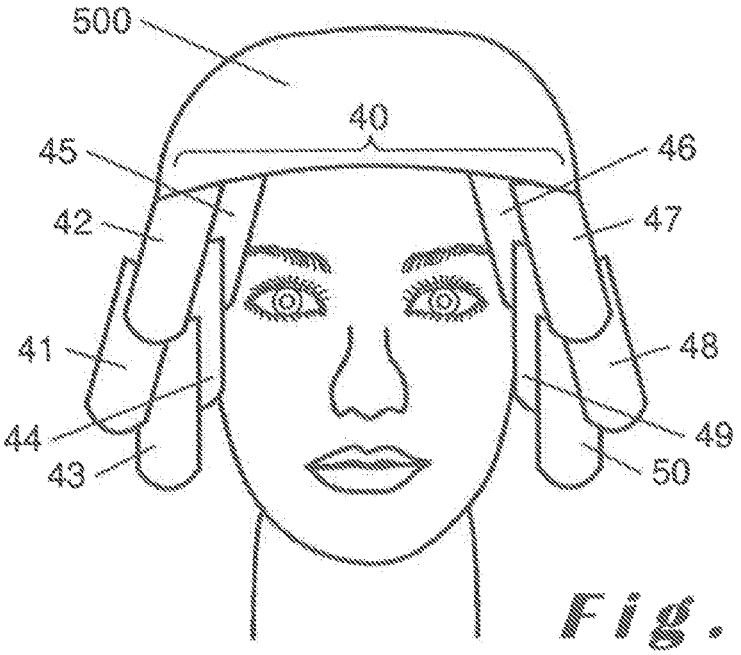
FIG. 7 shows various curler devices in the folded position when styling or perming hair.

In one variant, a cap 500, shown in FIG. 7, can be placed over the assembly 40 of curlers 41, 42, 43, 44, 45, 46, 47, 48, 49, 50 in their folded position. The use of a cap is preferable for hair with a thick diameter, as the cap provides a little more heat for good chemical penetration.

In an alternative, not illustrated in the Figures, for example when the curlers are not in the form of a bag, the curlers can be folded and/or rolled up and placed in an external bag, preferably made of hemp, during processing of the strands 200.

In one variant, the tightening step is performed using tightening means separate from the curler 1. These tightening means may be clamps, wires or bands and may be made, at least in part, of hemp.

In one variant, the tightening means can be made with metal wires, such as iron wire, as long as these wires are surrounded by hemp fibers. Preferably, the hair should never be brought into contact with elements made of metal and/or plastic. The hemp curler according to the invention enables the hair to benefit and receive only positive contributions from the hemp in the curler to achieve a beautiful hair.

The curler 1 of the invention is particularly suitable for use in two types of hair treatment technique: setting and perming. The use of the curler 1 of the invention is now described in more detail for these two techniques.

Setting Process with the Curler 1 of the Invention

In one embodiment, the process is a hair setting process comprising at least one hair heating step.

In a preferred embodiment, the hair strand 200 to be treated is wetted with water, at least partially and preferably entirely, before being positioned along the curler 1.

When we set hair by wetting it with water and then drying it, we act on the hair's sulfur bridges. When the hair is wet, the sulfur bridges are broken, as it is well known.

In the setting process, the hemp curlers are brought into contact with wet hair strands. The moisture provided allows all the benefits of hemp to be transferred while drying, during the setting of the curler shape.

Until now, this technique has been achieved by using a high-temperature drying helmet to allow the hair to take on its curly/wavy form.

To reap the benefits of hemp, the temperature of the curler must not exceed 60 degrees Celsius. It is therefore essential to use, for example, a low-temperature drying helmet, typically around 40° C. Low-temperature drying allows the curler to dry gently in contact with the hair, transferring all the cosmetic benefits of the hemp ingredients to the hair without overheating it. A set time is required for the hair to dry completely. Preferably 30-60 minutes.

The difference with conventional methods is that the material of the curler 1, when dried in the presence of humidity, enables the strand 200 and the hemp curler 1 to combine and deliver beneficial substances to the hair. By using hemp as the material for the curler, the hair strand 200 is impregnated with all the benefits of hemp, namely: improved elasticity, concentration of Omega 3, concentration of proteins. With the invention's process, hair is of better quality, with improved volume and shine. Also, by using the curler 1 of the invention it is possible to better create and control the desired shape of the hair strand 200.

It should also be noted that there is no risk of breakage with this type of curler, unlike known curlers. On the contrary, the curlers of the invention can even heal a broken hair by repeating the setting process every week.

It should be noted that curler 1 of invention 1 does not change its own shape during the process steps, even though hemp is a natural material. It is one of the strongest textiles available. Its combination as a support for wet hair leads to a surprising result in combining shaping and hair health, a combination that synthetic curlers do not offer at all.

Perming Process with the Curler Device 1 of the Invention

In one embodiment, the process is a hair perming process, comprising at least one chemical treatment step. The hair can be pre-washed and slightly damp.

Chemicals are preferably applied to the hair strand 200 after the curler 1 has been set in place, but preferably before the curler 1 is at least partially folded in the Y direction of its length.

The perming process of the invention is similar to a conventional perming process, but the curler is not harmful to the hair and is highly effective in shaping the hair into the curler 1.

Also, when the curler 1 of the invention is used in a chemical perming process, less chemicals are used. Using the hemp curler 1 means using less than 30%, preferably less than 50%, of chemicals. The reason for this is that the curler's flexible shape allows the strand 200 of hair to be distributed more evenly, forming a single, thin layer of hair and thus reducing the amount of chemicals required. The thickness of a thin layer of hair applied to the curler 1 is typically less than 20%, preferably less than 10%, and even more preferably less than 5% of the maximum width W of the curler. The most important aspect of the process is to achieve a single winding of the hair strand 200 with the curler 1.

In this case, the effect of hemp is less gentle on the hair than the styling/setting technique. However, the use of a hemp curler helps to prevent and reduce the harmful effects of chemical products on the hair.

As with conventional curlers, after the perm or styling/setting has been achieved, the curlers 1 are removed and the hairstyle is finished.

Experimental Results with a Prototype

The following section describes the creation of a prototype and its effects on the realization of a permanent set.

Figure 21:
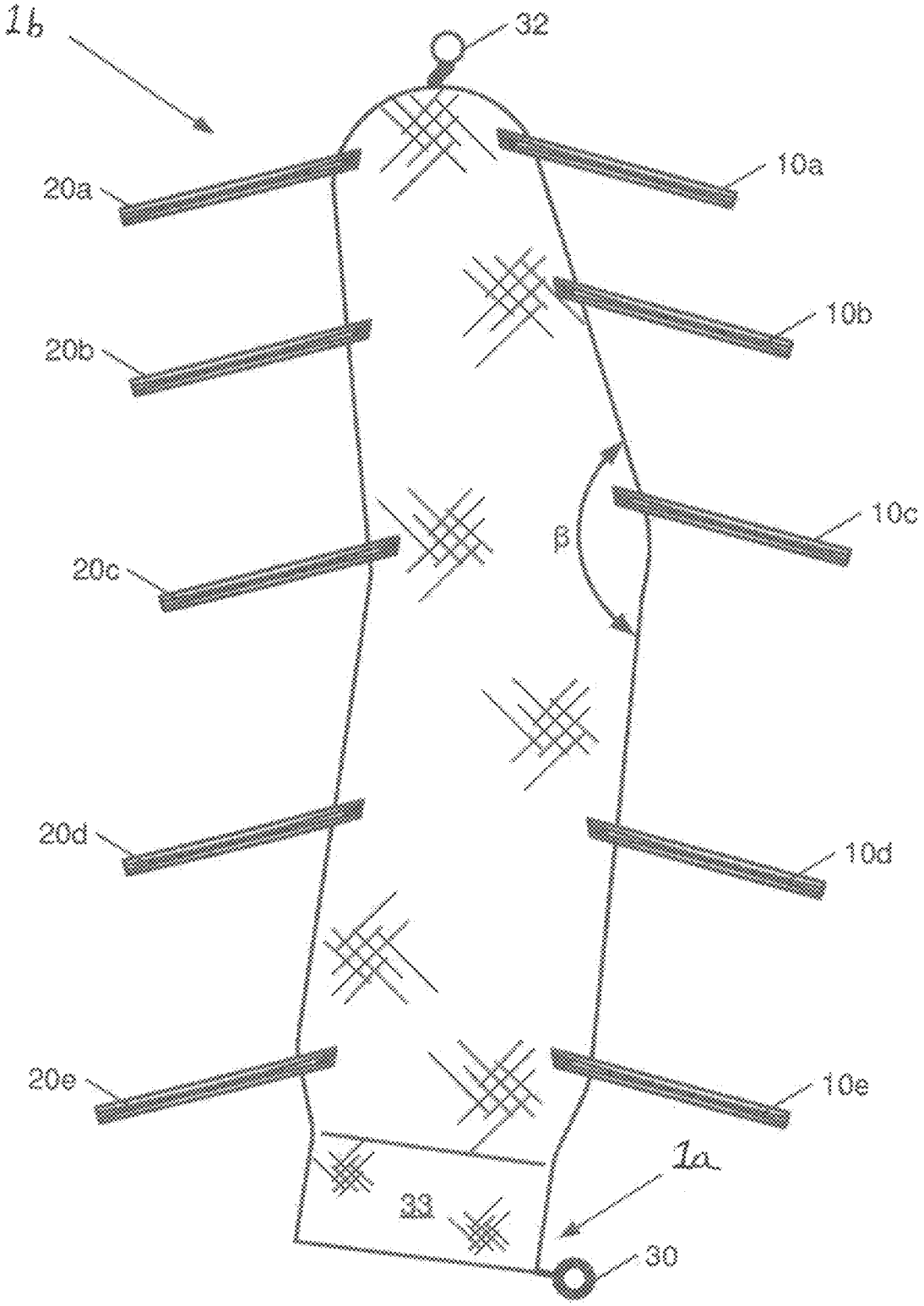
FIG. 21 illustrates a prototype of a curler device according to the invention.

In a first step, a curler was produced in the shape of an asymmetrical bag with an inclined central section β and a distal part 1*b* comprising an opening and a closed proximal end 1*b*. This is illustrated in FIG. 21. Fasteners 10*a*-20*e* have been made from cotton thread and to sew these fasteners wool has been used.

The prototype device was 35 cm long. The fasteners allow the curler 1 to hold properly when the hair is applied and rolled up.

The fasteners used were 10 cm long, and testing led to the conclusion that the best length was 12 cm.

It has been determined that the ideal curler width for any length of hair is 8 cm.

The results showed that the hair became shiny and the curl hold was very resistant. When tested on an exercise head with natural hair, the 202-208 curls produced did not fade even after 2 weeks.

How long the curls will last depends, of course, on your daily activities, but the shape of the curls that you keep after hair setting with the process of the invention will last an average of 5 days.

As the curlers 1 release some of the hemp substances onto the hair with each new use, this can lead to a decrease in the properties of each curler 1 over time. It can be estimated that the curlers gradually lose their properties and that it is necessary to renew the curlers regularly, probably after several months, i.e. on the order of several tens uses.

The explanations and figures relate to a curler forming device and the shaping and treatment method for a strand 200 of hair, but throughout the text "curler" may be replaced by "curler forming device", "hair" by "keratinous fibers, such as hair, animal hair, or other bristles" and "strand of hair" by "strands of keratinous fibers, such as hair, animal hair, or other bristles".

The invention claimed is:

1. A method for shaping a strand of hair or other keratinous fibers, comprising:

providing a device for receiving at least one strand of hair or other keratinous fibers, the device having at least one strand-receiving surface configured to enable the formation of, from at least one strand of hair or other keratinous fibers, at least two undulations having winding axes that are not colinear with one another and/or are of different diameters, wherein the device is an elongate bag having a distal end and a proximal end, said distal end having an opening, wherein the strand-receiving surface is at least partially made from hemp;

wherein the device includes a tubular slide formed at or adjacent to an edge defining the opening, and an elongate member including two straps on opposite ends thereof extending through and from within the tubular slide to an exterior thereof, the two straps being constructed and arranged to be selectively pullable to selectively constrict the opening and to attach the distal end of the device to a relatively proximal portion of the elongate bag;

positioning a strand of hair or other keratinous fibers so that at least a portion of the strand is in contact with at least one surface of said device;

wetting the strand;

making a simple knot in the device together with the strand of hair at a relatively proximal part of the device;

twisting the device and the strand of hair positioned therealong about its length (L) to interlace the strand with the device taken along its length (L);

laterally tightening the device at a plurality of points to hold the strand against the at least one surface of the device;

folding back the distal portion of the device back over the device to dispose at least part of the proximal end including the simple knot into said opening; and constricting the opening at the distal end of the device with the two straps and fixing the two straps to one another to maintain the constriction of the opening.

2. The method according to claim 1, further comprising a drying step at a temperature below 60° C.

3. The method according to claim 1, wherein the width of the device, before twisting the device, and for any section of the strand along the length L of the device, is 50% wider than the width of the strand, and preferably 2 times wider than the width of the strand.

4. The method according to claim 1, further comprising a drying step at a temperature below 50° C.

5. The method according to claim 1, further comprising a drying step at a temperature below 45° C.

* * * * *